US007814692B2

(12) United States Patent
Wiltfang et al.

(10) Patent No.: US 7,814,692 B2
(45) Date of Patent: Oct. 19, 2010

(54) OUTRIGGER

(75) Inventors: Rohland Wiltfang, Minneapolis, MN (US); Erica Martin, Minneapolis, MN (US); Tracy Tonnessen, Minneapolis, MN (US); Mark Waite, Coon Rapids, MN (US); Conrad M. Chin, Minneapolis, MN (US); Eric J. Weiss, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 305 days.

(21) Appl. No.: 12/116,084

(22) Filed: May 6, 2008

(65) Prior Publication Data

US 2009/0277060 A1 Nov. 12, 2009

(51) Int. Cl.
*G09G 3/00* (2006.01)

(52) U.S. Cl. ..... 40/642.01; 40/649; 40/661.05; 40/606.18; 40/611.06

(58) Field of Classification Search ..... 40/642.01, 40/649, 654.01, 661.05, 661.11, 606.01, 40/606.18, 611.06, 734
See application file for complete search history.

(56) References Cited

U.S. PATENT DOCUMENTS

| | | | | |
|---|---|---|---|---|
| 1,729,417 | A | | 9/1929 | Courtenay |
| 1,741,118 | A | | 12/1929 | Rosenfeld et al. |
| 1,854,145 | A | | 4/1932 | Wright |
| 1,947,341 | A | | 2/1934 | Hallowell |
| 1,952,250 | A | | 3/1934 | Hallowell et al. |
| 4,209,928 | A | | 7/1980 | Kraayvanger |
| 4,805,331 | A | * | 2/1989 | Boggess et al. ..... 40/651 |
| 4,909,464 | A | | 3/1990 | Levine et al. |
| 5,233,773 | A | * | 8/1993 | Reynolds ..... 40/661.03 |
| 5,442,873 | A | * | 8/1995 | Vogler ..... 40/649 |
| 5,582,376 | A | * | 12/1996 | Thompson ..... 248/214 |
| 5,617,661 | A | | 4/1997 | Mason |
| D419,604 | S | | 1/2000 | Emmett |
| 6,202,334 | B1 | * | 3/2001 | Reynolds et al. ..... 40/642.02 |
| 6,651,369 | B1 | | 11/2003 | Keating et al. |
| D514,165 | S | | 1/2006 | McCudden et al. |
| D526,362 | S | | 8/2006 | Priegel |
| 7,513,074 | B2 | * | 4/2009 | Glenn et al. ..... 40/649 |
| 2002/0174582 | A1 | | 11/2002 | Garfinkle et al. |
| 2005/0241201 | A1 | * | 11/2005 | Lindquist et al. ..... 40/642.02 |

* cited by examiner

*Primary Examiner*—Gary C Hoge
(74) *Attorney, Agent, or Firm*—Griffiths & Seaton PLLC

(57) ABSTRACT

A signage system includes a support, a housing attached to the support, and a first sign. The support includes a substantially horizontal member having a first end and a second end; a bracket for mounting the support to an upright, the bracket being attached to the first end of the substantially horizontal member; and a shell extending from the second end of the substantially horizontal member. The housing is attached within the shell of the support and includes a first ring, a second ring connected to the first ring, a first plate, and a second plate positioned adjacent to the first plate. The first plate and the second plate are positioned between the first ring and the second ring. The first sign is releasably retained between the first ring and the first plate by frictional engagement of edges of the first sign with the first ring and the first plate. The signage system is adapted to be supported by the bracket in a cantilevered configuration.

17 Claims, 16 Drawing Sheets

OUTRIGGER

BACKGROUND

Various types of signs are used to provide information to consumers in a retail environment. For example, signs are positioned at the end of merchandising aisles to inform consumers of the products that are located in that aisle. Signs that are eye-catching and that readily provide information help draw the attention of the consumers and promote retail sales. Additionally, signs that are easily changeable are versatile and adaptable for use in different areas. Such signs provide a more efficient use of resources, including better use of employee time and reduced costs. As such, it is desirable to provide signage systems characterized as visually pleasing, informative, adaptable and readily assembled. While traditional displays accomplish these features to some extent, enhancements in the functionality, or overall merchandising effectiveness, of such signage systems remain to be realized.

SUMMARY

Some aspects relate to a signage system including a support, a housing attached to the support, and a first sign. The support includes a substantially horizontal member having a first end and a second end; a bracket for mounting the support to an upright, the bracket being attached to the first end of the substantially horizontal member; and a shell extending from the second end of the substantially horizontal member. The housing is attached within the shell of the support and includes a first ring, a second ring connected to the first ring, a first plate, and a second plate positioned adjacent to the first plate. The first plate and the second plate are positioned between the first ring and the second ring. The first sign is releasably retained between the first ring and the first plate by frictional engagement of edges of the first sign with the first ring and the first plate. The signage system is adapted to be supported by the bracket in a cantilevered configuration.

Various other aspects are contemplated and should be understood with reference to the text and drawings that follow.

Figure 1:
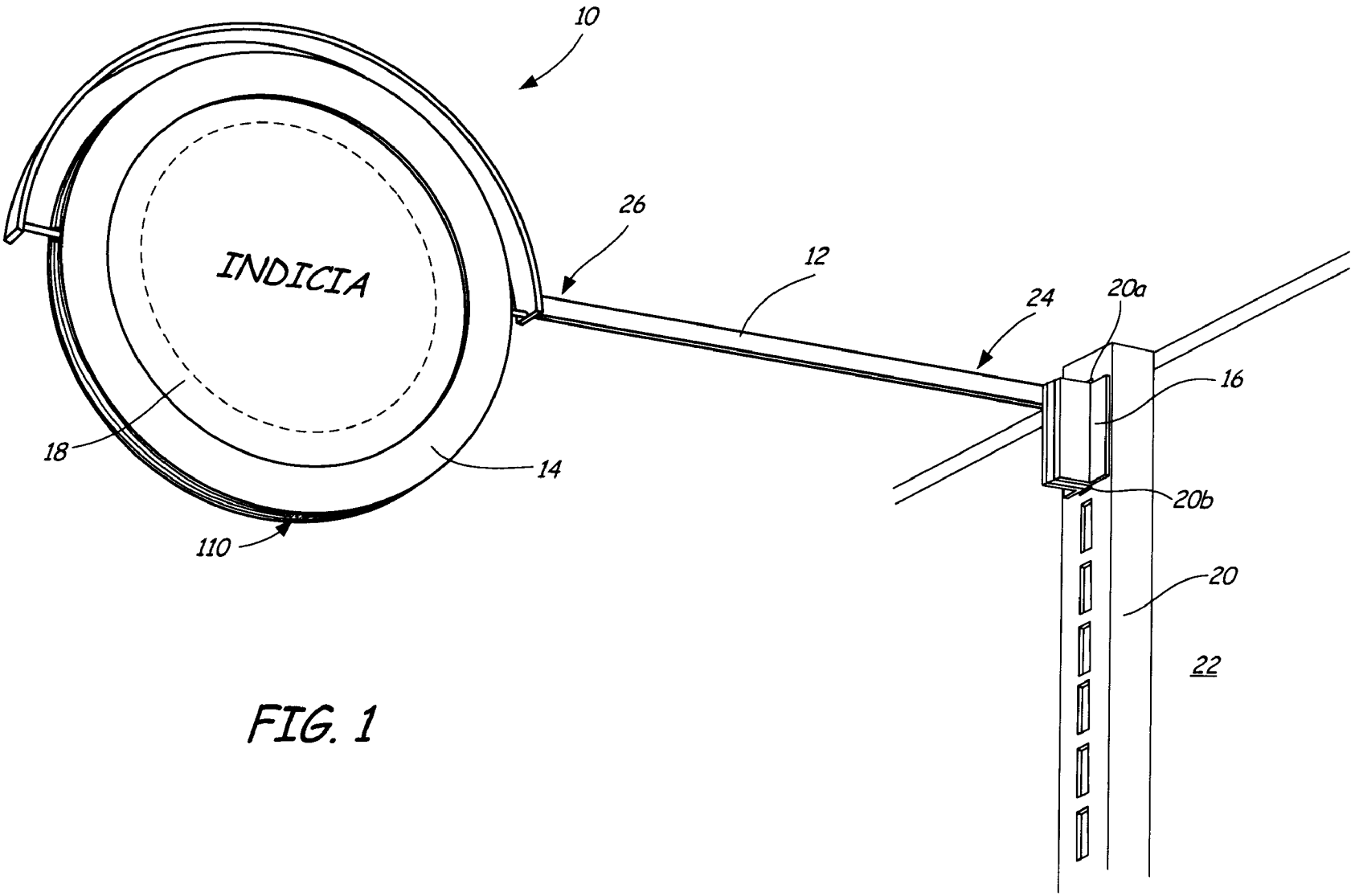
FIG. 1 is a perspective view of a cantilever signage system, according to some embodiments.

While the invention is amenable to various modifications and alternative forms, some embodiments have been shown by way of example in the drawings and are described in detail below. As alluded to above, the intention, however, is not to limit the invention by those examples. On the contrary, the invention is intended to cover all modifications, equivalents, and alternatives.

DETAILED DESCRIPTION

In general terms, some aspects of the invention relate to cantilevered signs secured to an end of an aisle or other fixture in a retail environment, for example. The cantilevered signs optionally display product information or other retail information as desired.

FIG. 1 shows a perspective view of a cantilever signage system 10 for displaying informational signs. The cantilever signage system 10, also described as an informational system, includes a support 12, a housing 14, a bracket 16 and a sign 18. The support 12 is connectable to a substantially vertical upright 20, or standard, of a base assembly 22, such as at an end of an aisle. The bracket 16 and support 12 project from a target hole 20*a* of the substantially vertical upright 20 in a cantilever fashion with a first end 24 of the cantilever signage system 10 being secured to the substantially vertical upright 20 by the bracket 16 and a second end 26 of the cantilever signage system 10 being a free end, or otherwise unsupported such that the first end 24 carries the load of the cantilever signage system 10, including housing 14. In the this position, the housing 14 extends substantially horizontally outward from the base assembly 22 and is suspended above a retail floor. The cantilever signage system 10 protrudes from the substantially vertical upright 20 such that when the sign 18 is inserted within the housing 14, the sign 18 is in plain view of a consumer in proximity to the base assembly 22. The sign 18 positioned within the cantilever signage system 10 optionally provides an area to display information related to products or other indicia as shown generally by dashed lines in FIG. 1.

Figure 2:
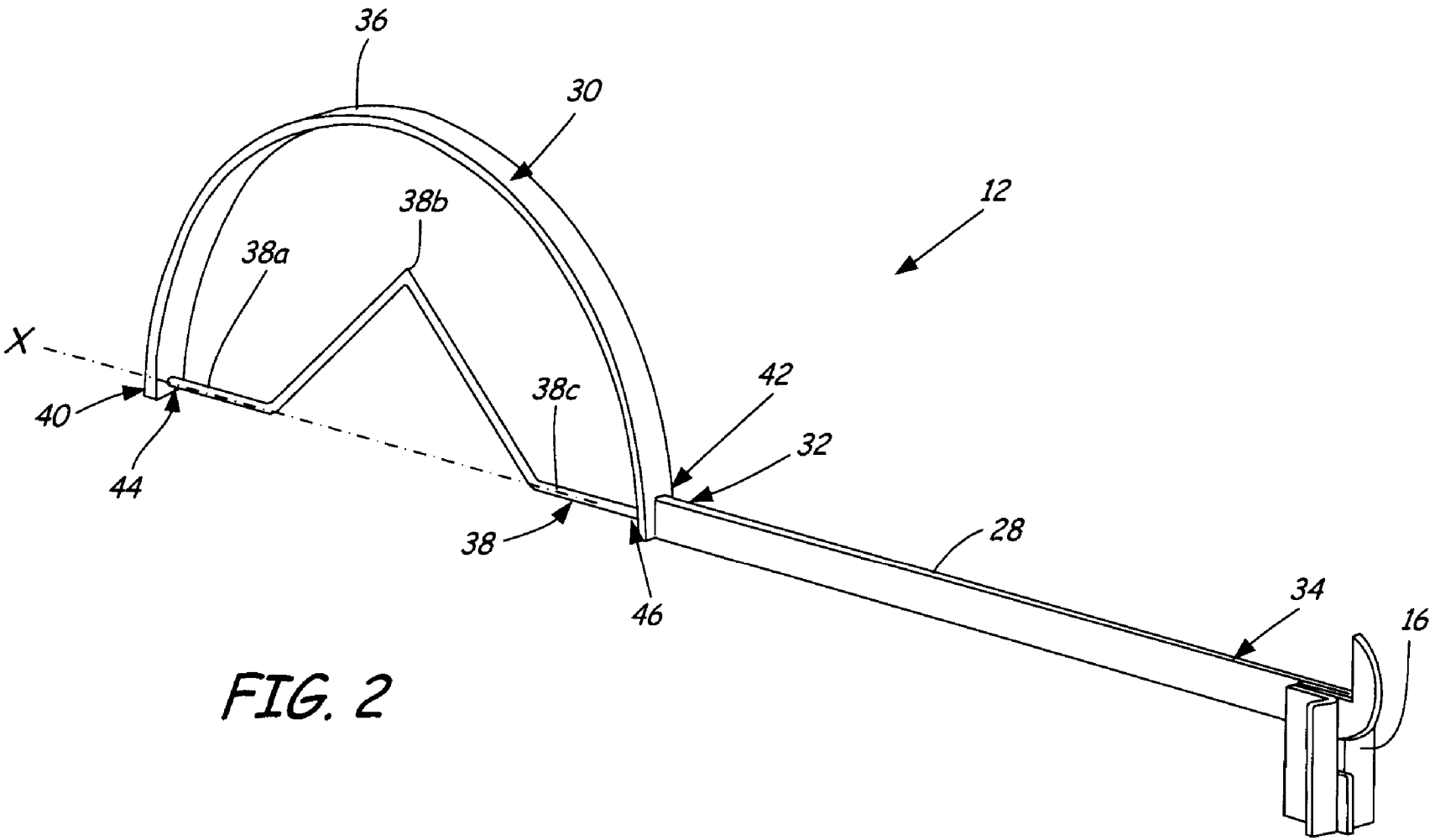
FIG. 2 is a perspective view of a support of the cantilever signage system of FIG. 1, according to some embodiments.

FIG. 2 shows a perspective view of the support 12 of the cantilever signage system 10 (shown in FIG. 1), according to some embodiments. The support 12, also described as an extension, includes an elongate, substantially horizontal arm 28 and a semi-circular shell 30. The arm 28, also described as a mount, has a first end 32 and a second end 34. The first end 32 of the arm 28 is connected to the shell 30 and the second end 34 of the arm 28 is connected to the bracket 16. The arm 28 is about 12 inches long, about 0.13 inches thick and about 0.5 inches high, although other dimensions are contemplated.

The semi-circular shell 30, also described as a casing, includes a curved member 36 and an engagement member 38. The curved member 36 has a first end 40 and a second end 42 and forms an arc between the first and second ends 40, 42. The second end 42 of the curved member 36 is attached to the first end 32 of the arm 28 and is bent such that the first end 40 of the curved member 36 is aligned with an axis X of the arm 28. Although FIG. 2 depicts the curved member 36 as being semi-circular, the curved member 36 optionally takes other shapes, such as substantially rectangular, square or oval.

The engagement member 38, also described as an engagement portion, is positioned within the arc of the curved member 36 between the first and second ends 40, 42 and is comprised of a thin bar that is bent to take a particular shape. The engagement member 38 has a first end 44 attached to the first end 40 of the curved member 36 and a second end 46 attached to the second end 42 of the curved member 36. According to some embodiments, the engagement member 38 has a first portion 38*a*, a center portion 38*b*, and a second portion 38*c*. The center portion 38*b* resembles two sides of a triangle with the first and second portions 38*a*, 38*c* extending from the center portion 38*b* to the first and second ends 44, 46 of the engagement member 38 to attach to the first and second ends 40, 42 of the curved member 36, respectively. Although FIG. 2 depicts the engagement member 38 as having a particular shape, the engagement member 38 may take a variety of other shapes. The curved member 36 has a radius of about 4.25 inches to about 5.25 inches, is about 0.5 inches wide and about 0.13 inches high, although other dimensions are contemplated.

Figure 3A:
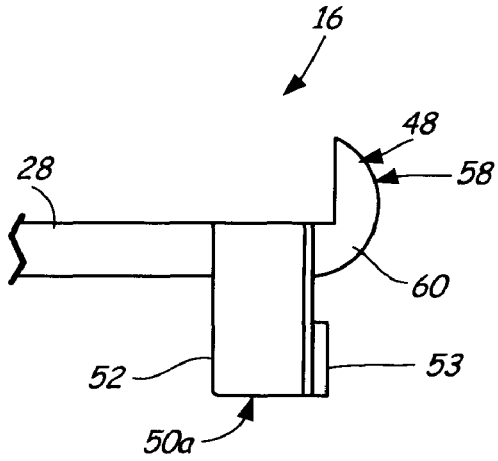
FIG. 3A is a side view of a bracket of the support of FIG. 2, according to some embodiments.
Figure 3B:
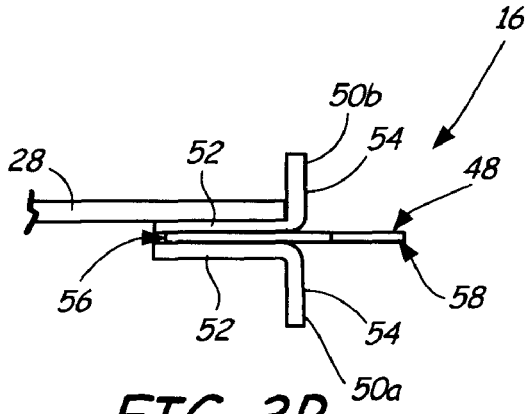
FIG. 3B is a top view of the bracket of FIG. 3A, according to some embodiments.
Figure 3C:
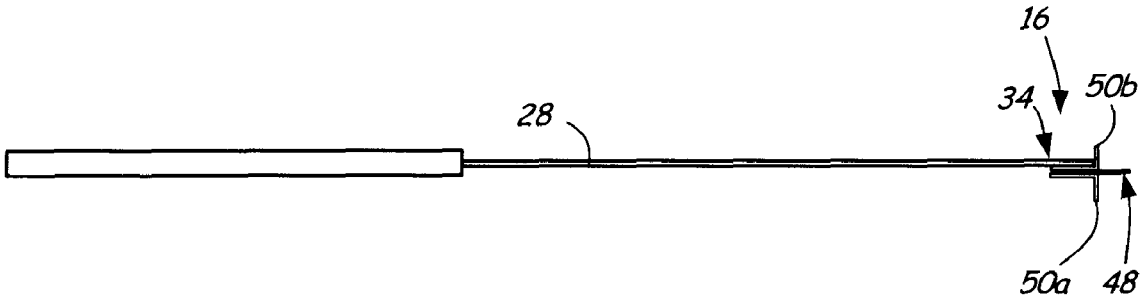
FIG. 3C is a top view of the bracket of FIG. 3A mounted to the support of FIG. 2, according to some embodiments.

FIGS. 3A and 3B show a side view and a top view of the bracket 16, according to some embodiments. FIG. 3C shows a top view of the bracket 16 mounted to the support 12. The bracket 16 includes a catch 48 positioned between a first L-shaped flange 50*a* and a second L-shaped flange 50*b* (the first and second flanges 50*a*, 50*b* are collectively referred to as "flanges 50"). Each of the first and second flanges 50*a*, 50*b* includes a connection portion 52 and a balance portion 54 connected substantially normally to the connection portion 52. As can be seen in FIG. 3A, the balance portion 54 is connected to the connection portion 52 such that a tab 53 protrudes past the balance portion 54.

The catch 48 includes a substantially linear portion 56 and a tip portion 58. The substantially linear portion 56 of the catch 48 includes a tail 60 that attaches the tip portion 58 to the substantially linear portion 56. The catch 48 is attached to the connection portions 52 of the flanges 50 at the substantially linear portion 56 proximate the tail 60 such that when the catch 48 is attached to the flanges 50, the tail 60 of the catch 48 extends past the flanges 50. When the catch 48 is attached to the connection portions 52, the tip portion 58 extends substantially perpendicularly to the flanges 50. The catch 48 and flanges 50 are connected by any suitable means, such as for example, welding.

The bracket 16 is attached to the second end 34 of the arm 28 at the intersection of the connection portion 52 and the balance portion 54 of the first flange 50*a*. The first flange 50*a* is attached to the second end 34 of the arm 28 by any suitable means, including, but not limited to, welding. As will be discussed in more detail below, the bracket 16 is secured to the substantially vertical upright 20 (shown in FIG. 1) by positioning the tip portion 58 of the catch 48 in the target hole 20*a* of the substantially vertical upright 20.

The connection portions 52 of the flanges 50 are about 1.31 inches long, about 0.13 inches wide and about 1.63 inches high, although other dimensions are contemplated. The balance portions 54 of the flanges 50 are about 1.06 inches long, about 0.13 inches wide and about 1.63 inches high, although other dimensions are contemplated. The substantially linear portion 56 of the catch 48 is about 0.82 inches long to about 1 inch long (excluding the tail 60), about 0.92 inches high (excluding the tail 60) and about 0.075 wide, although other dimensions are contemplated. The tail 60 of the substantially linear portion 56 is about 0.94 inches long, 0.71 inches high and about 0.075 inches wide, although other dimensions are contemplated. The tip portion 58 of the catch 48 is about 0.81 inches high and about 0.075 inches thick, although other dimensions are contemplated. The flanges 50 are positioned about 0.18 inches away from the tip portion 58 of the catch 48, although other dimensions are contemplated.

Figure 4:
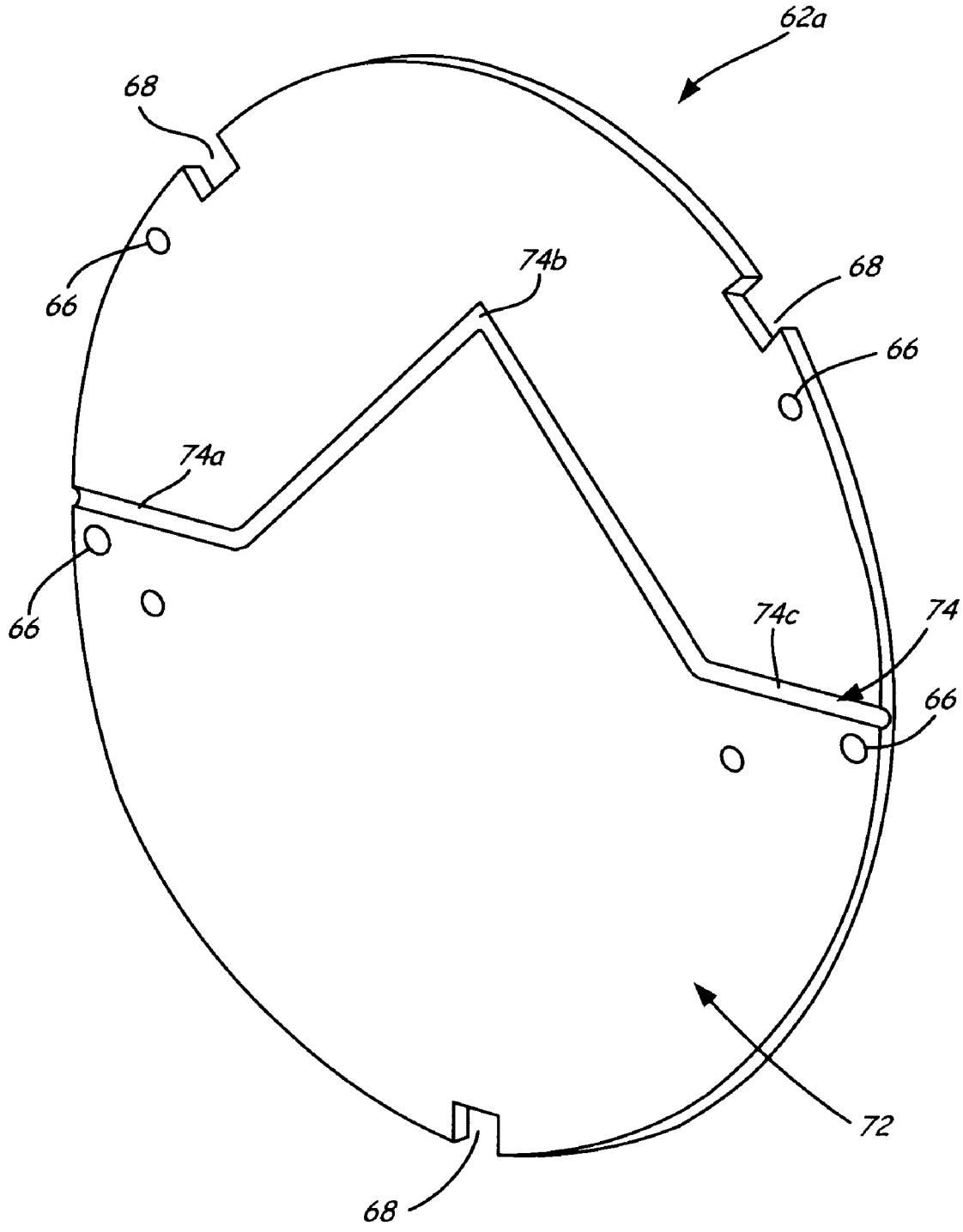
FIG. 4 is a perspective view of a plate of the cantilever signage system of FIG. 1, according to some embodiments.
Figure 5:
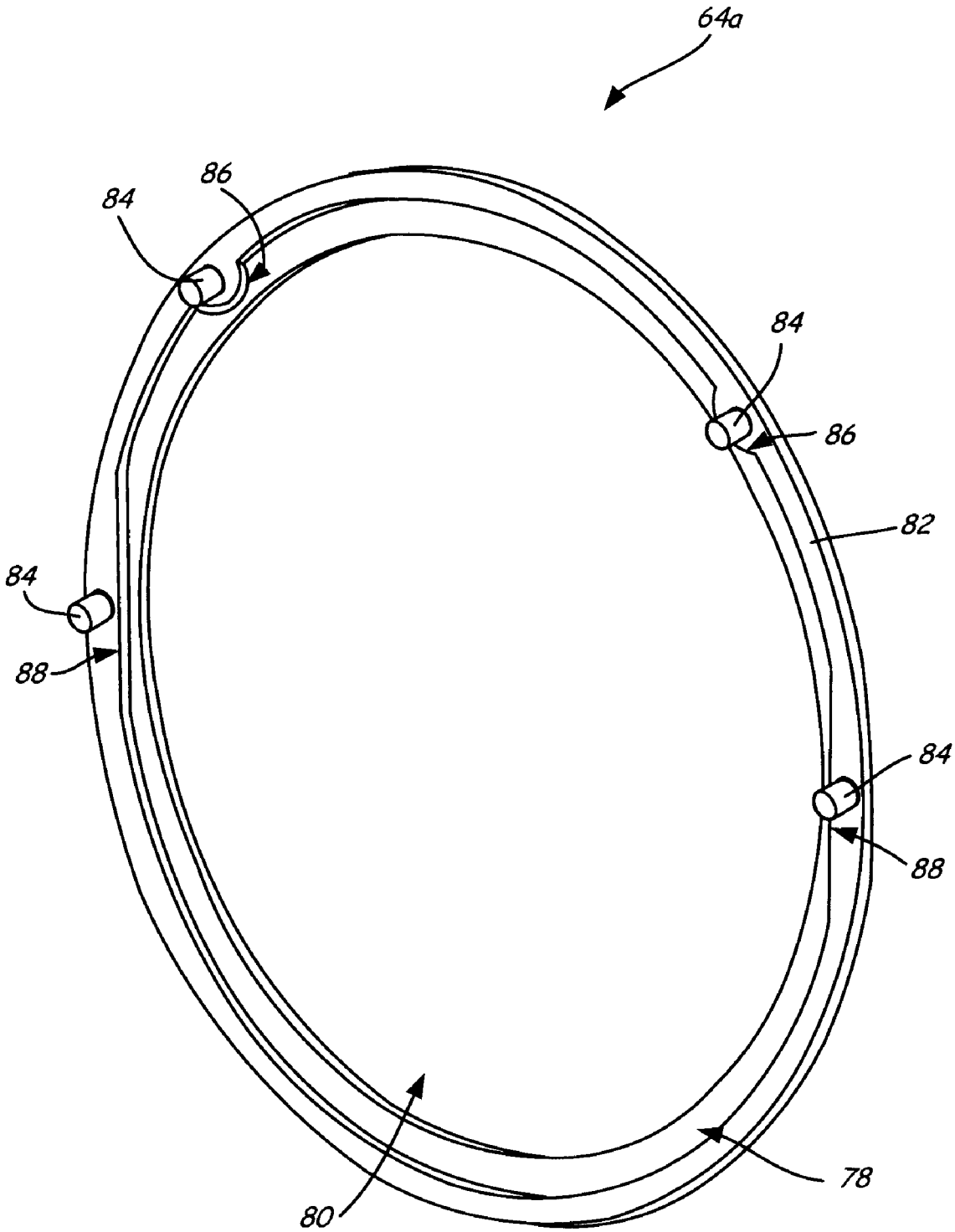
FIG. 5 is a perspective view of a ring of the cantilever signage system of FIG. 1, according to some embodiments.
Figure 6:
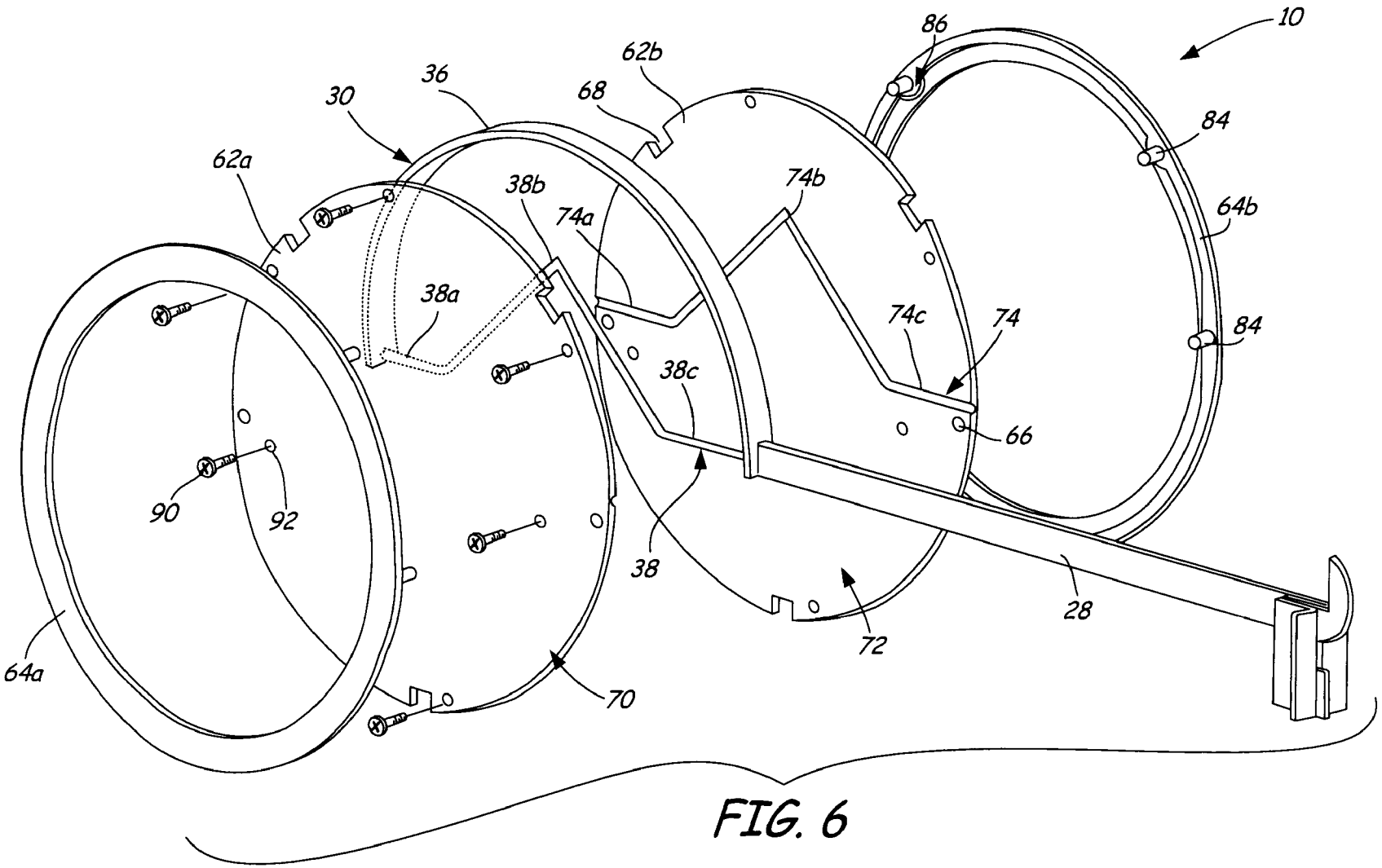
FIG. 6 is an exploded view of the cantilever signage system of FIG. 1, according to some embodiments.

The housing 14, also described as a signholder, includes a first plate 62*a*, a second plate 62*b*, a first ring 64*a* and a second ring 64*b* (the first and second rings 64*a* and 64*b* are shown in FIGS. 5 and 6). FIG. 4 shows a perspective view of the first plate 62*a*, according to some embodiments. The second plate 62*b* (shown in FIG. 6) is optionally substantially similar to the first plate 62*a*, and as such can be described cumulatively with reference to the first plate 62*a*. The first and second plates 62*a*, 62*b*, also described as discs or panels, will collectively be referred to as "plates 62". As can be seen in FIG. 4, the first plate 62*a* has a circular shape with a plurality of apertures 66 and a plurality of cut-outs 68 along the perimeter. The first plate 62*a* has a substantially smooth first surface 70 (shown in FIG. 6) and a second surface 72 which includes a recess 74. The first plate 62*a* is sized to fit within the curved member 36 of the shell 30 (shown in FIG. 2) and thus has substantially the same radius as the shell 30, although the radius of the first plate 62*a* may be slightly smaller than the shell 30 to ensure that the first plate 62*a* is positionable within the shell 30.

The recess 74, also described as an imprint, of the first plate 62*a* is designed to match the shape of the engagement member 38 of the support 12 (shown in FIGS. 2 and 3) and includes a first portion 74*a*, a center portion 74*b* and a second portion 74*c*. Each of the portions 74*a*-74*c* of the recess 74 matches the portions 38*a*-38*c* of the engagement member 38, respectively. Thus, the center portion 74*b* of the recess 74 resembles two sides of a triangle and the first and second portions 74*a*, 74*c* extend from the center portion 74*b* to the outer perimeter of the first plate 62*a*, according to some embodiments. Although FIG. 4 depicts the first plate 62*a* as being circular, the first plate 62*a* is optionally any of a variety of shapes such as substantially rectangular, square or oval, for example.

FIG. 5 shows a perspective view of the first ring 64*a*. The second ring 64*b* is optionally substantially similar to the first ring 64*a*, and as such can be described cumulatively with reference to the first ring 64*a*. The first and second rings 64*a*, 64*b*, also described as hoops or frames, will collectively be referred to as "rings 64". The first ring 64*a* has a smooth first surface 76 (shown in FIG. 6) and a second surface 78 with a hole 80, or open interior, extending through the first and second surfaces 76, 78. The second surface 78 of the first ring 64*a* includes a step 82 from the inner perimeter to the outer perimeter and a plurality of posts 84 positioned along the perimeter. Each of the rings 64*a*, 64*b* has a radius of about 4.25 inches and is about 0.19 inches wide, although other dimensions are contemplated.

The hole 80 of the first ring 64*a* allows a viewer to observe a sign positioned within the housing 14 when the housing 14 is assembled on the support 12 (shown in FIG. 1).

The step 82 extends between the inner and the outer perimeter of the first ring 64*a* and includes bumps 86 and linear portions 88 where the posts 84 extend from the first ring 64*a*.

The posts 84 are sized to engage the apertures 66 of the plates 62 (shown in FIG. 4) and maintain the rings 64 to the plates 62. Although FIG. 5 depicts the first ring 64*a* as having four posts 84, the first ring 64*a* optionally includes greater or fewer posts as desired.

FIG. 6 shows an exploded view of the cantilever signage system 10. When assembling the cantilever signage system 10, the plates 62 are first aligned with the curved member 36 and the engagement member 38 of the shell 30. As previously mentioned, the recesses 74 of the plates 62 are designed to match the shape of the engagement member 38 of the shell 30. Thus, when the plates 62 are positioned against the engagement member 38, the first portions 74*a* of the recesses 74 of the plates 62 accept the first portion 38*a* of the engagement member 38, the center portions 74*b* of the recesses 74 of plates 62 accept the center portion 38*b* of the engagement member 38 and the second portions 74*c* of the recesses 74 of plates 62 accept the second portions 38*c* of the engagement member 38. In this position, the plates 62 are positioned within the curved member 36. Once the plates 62 are positioned with respect to the shell 30, the plates 62 are secured to the shell 30 and to each other by passing a plurality of screws 90 through screw holes 92 located around the perimeter of the plates 62.

Once the plates 62 are properly secured to the shell 30 and to each other, the posts 84 of the rings 64 are aligned with the apertures 66 of the plates 62 and the bumps 86 of the rings 64 are aligned with the cut-outs 68 of the plates 62. The posts 84 are guided toward the plates 62 until the posts 84 engage the apertures 66. The rings 64 are frictionally held to the plates 62 when the posts 84 are engaging the apertures 66. The rings 64 are optionally more securely fixed to the plates 62 by placing an adhesive on the posts 84 or within the apertures 66 prior to engaging the posts 84 with the apertures 66.

After assembling the plates 62 to the shell 30 and the rings 64 to the plates 62, the cantilever signage assembly 10 is ready for installation onto the substantially vertical upright 20 (shown in FIG. 1). As can be seen in FIG. 1, when the cantilever signage system 10 is assembled, the housing 14 is concentric to the curved member 36. In addition, only the bottom half of the rings 64 are able to come apart from the plates 62.

Figure 7A:
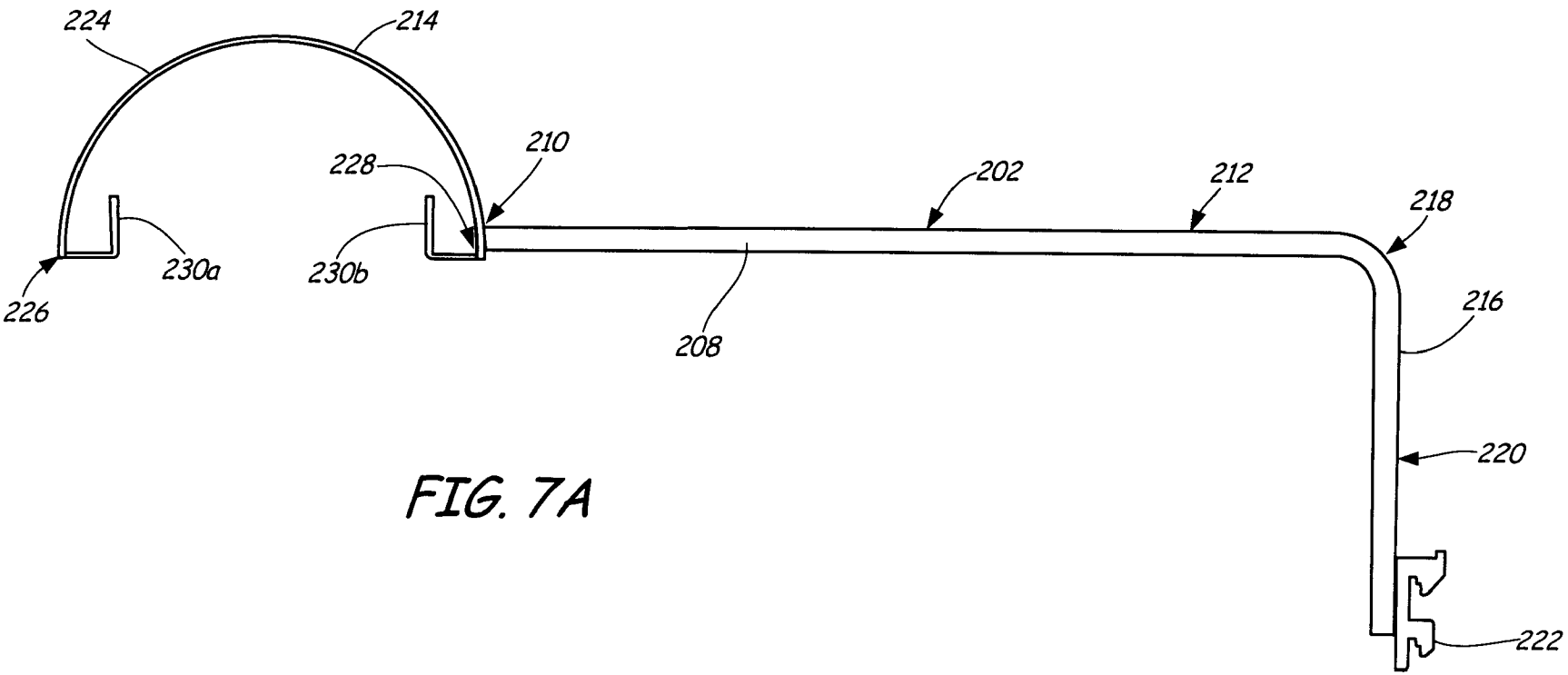
FIG. 7A is a side view of an embodiment of the support of FIG. 3, according to some embodiments.
Figure 7B:
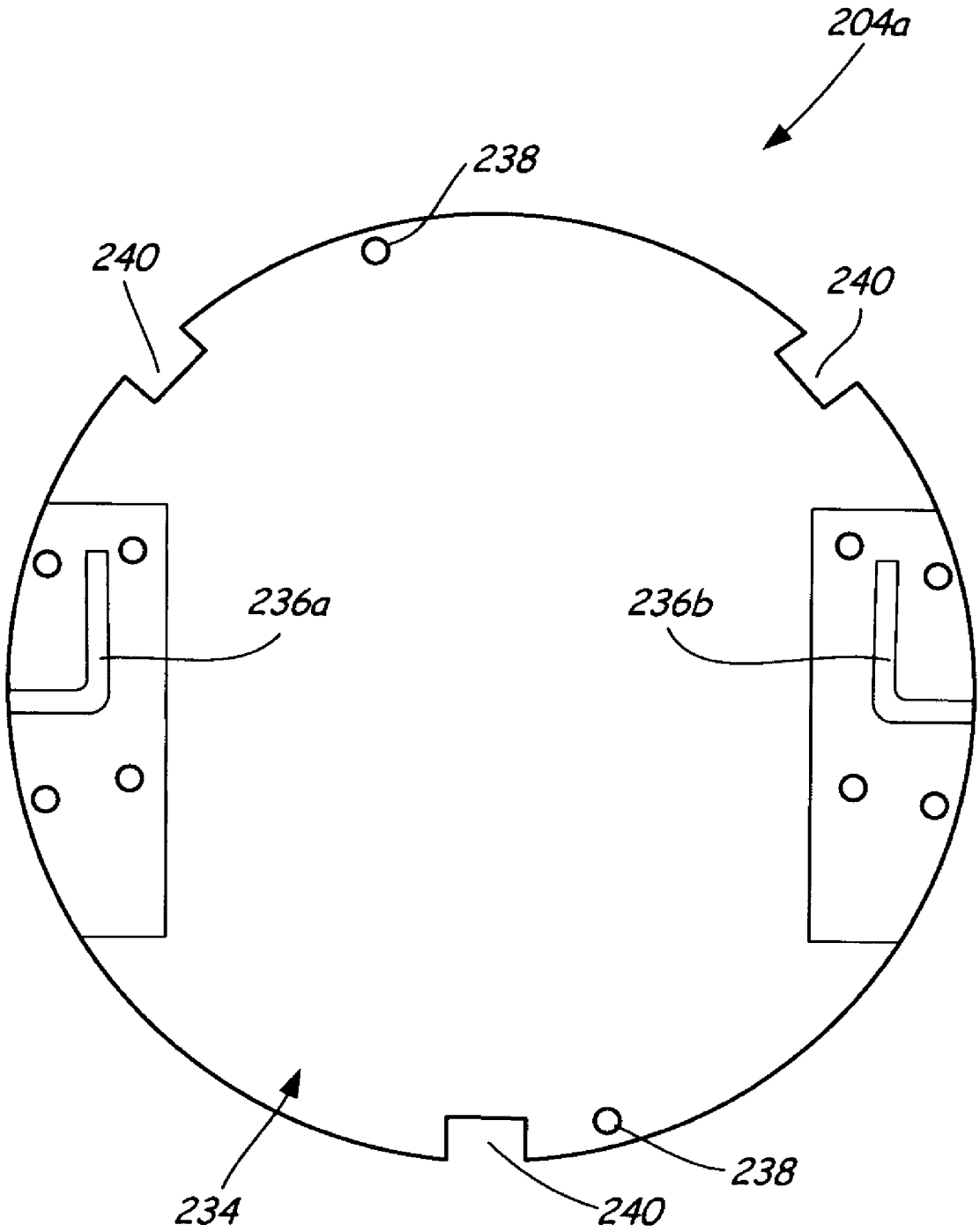
FIG. 7B is a front view of an embodiment of the plate of FIG. 4, according to some embodiments.
Figure 7C:
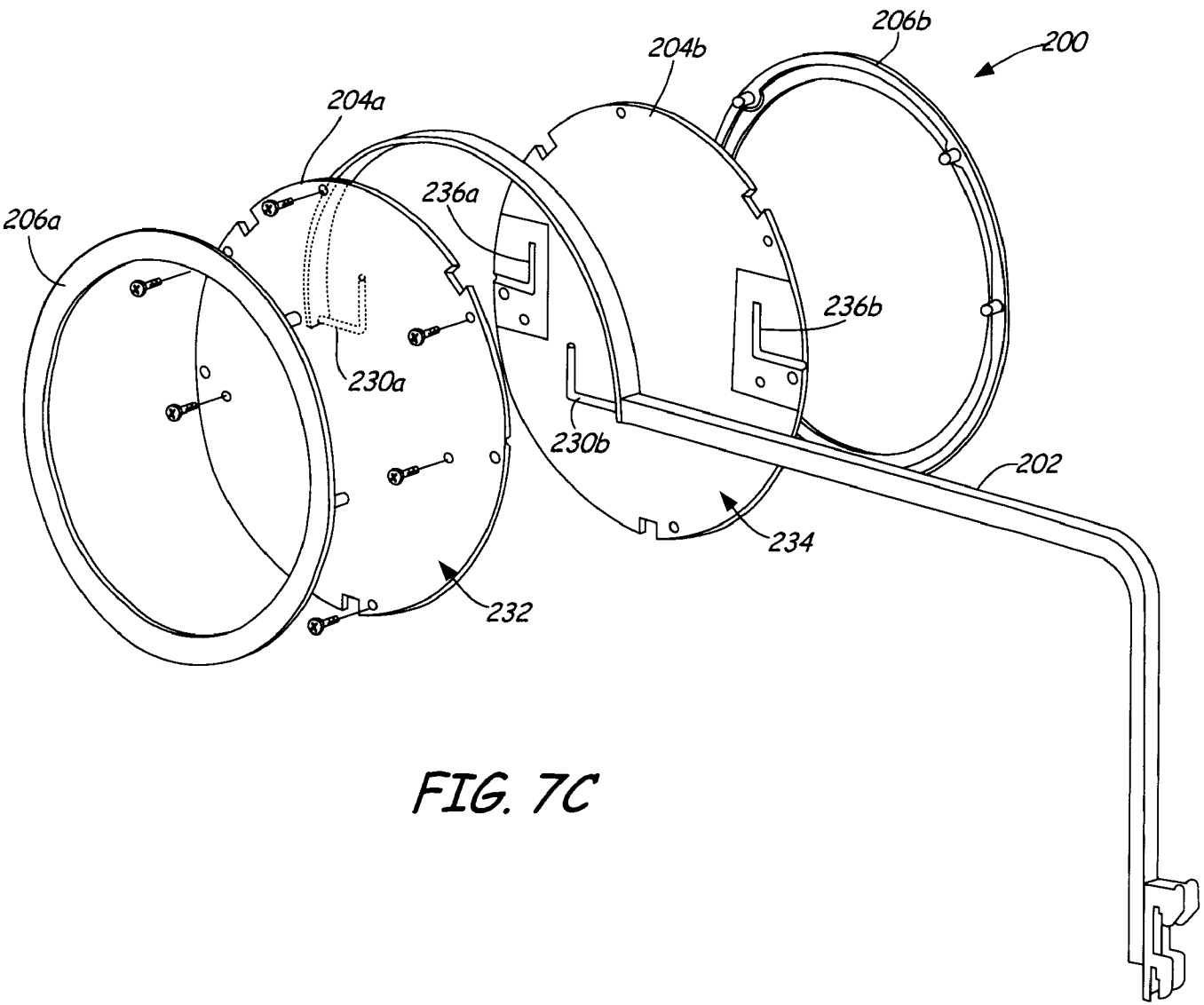
FIG. 7C is an exploded view of a cantilever signage system with the support of FIG. 7A and the plate of FIG. 7B, according to some embodiments.

FIGS. 7A-7C show an alternative cantilever signage system 200 and will be discussed in conjunction with one another. FIG. 7A shows a front view of an alternative support 202. FIG. 7B shows a front view of an alternative plate 204. FIG. 7C shows an exploded view of the cantilever signage system 200. The cantilever signage system 200 includes support 202, first plate 204*a* and second plate 204*b* (collectively referred to as "plates 204") and first ring 206*a* and second ring 206*b* (collectively referred to as "rings 206"). The support 202, plates 204 and rings 206 of the cantilever signage system 200 generally function and interact with each other in the same manner as the support 12, plates 62 and rings 64 of the cantilever signage system 10 (shown in FIGS. 1-6). Referring to FIG. 7A, the support 202 includes a substantially horizontal arm 208 having a first end 210 and a second end 212. A semi-circular shell 214 is attached to the first end 210 of the substantially horizontal arm 208 and a substantially vertical arm 216 is attached to the second end 212 of the substantially horizontal arm 208. The substantially vertical arm 216 has a first end 218 and a second end 220. The first end 218 of the substantially vertical arm 216 is attached to the second end 212 of the substantially horizontal arm 208 at about a 90° angle, for example. A bracket 222 is attached at the second end 220 of the substantially vertical arm 216 and is connectable to the substantially vertical upright 20 (shown in FIG. 1).

The shell 214 includes a curved member 224 having a first end 226 and a second end 228, a first engagement member 230*a* and a second engagement member 230*b*. The first engagement member 230*a* is attached to the first end 226 of the curved member 224 and the second engagement member 230*b* is attached to the second end 228 of the curved member 224. The engagement members 230*a*, 230*b* (collectively referred to as "engagement members 230") resemble an inverted L-shape and an L-shape, respectively.

As shown in FIGS. 7B and 7C, each of the plates 204 includes a smooth first surface 232 and a second surface 234. The second surfaces 234 of the plates 204 each include a first recess 236*a*, a second recess 236*b*, a plurality of apertures 238 and a plurality of cut-outs 240 along the perimeter. The first and second recesses 236*a*, 236*b* (collectively referred to as "recesses 236") are designed to match the shape of the engagement members 230. While the shapes of the engagement members 230 and the recesses 236 are substantially similar to one another, the shapes may vary from one another with at least a portion of the engagement members 230 engaging the recesses 236.

Figure 7D:
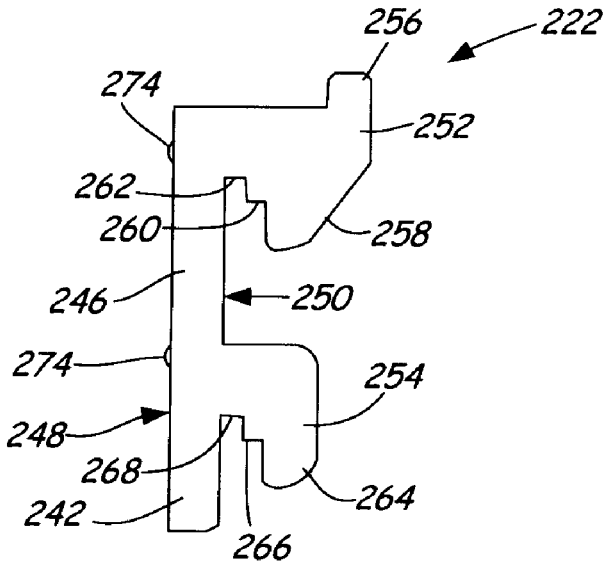
FIG. 7D is a side view of a bracket of the cantilever signage system of FIG. 7C, according to some embodiments.
Figure 7E:
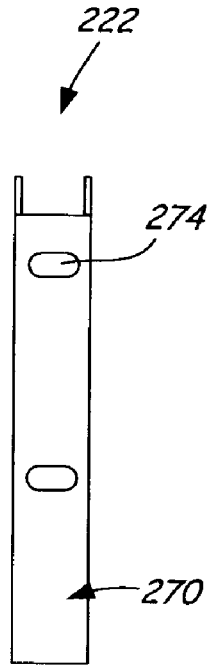
FIG. 7E is a rear view of the bracket of FIG. 7D, according to some embodiments.
Figure 7F:
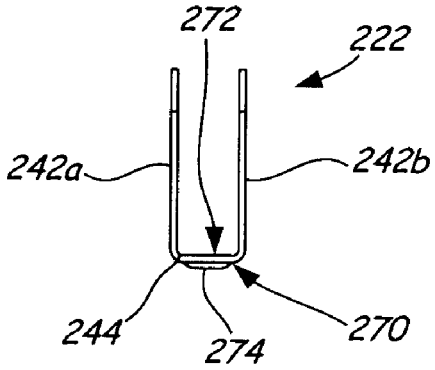
FIG. 7F is a top view of the bracket of FIG. 7D, according to some embodiments.

FIGS. 7E, 7D and 7F show side, rear, and top views of the bracket 222, respectively. As shown in FIG. 7F, the bracket 222 includes a first substantially F-shaped flange 242*a*, a second substantially F-shaped flange 242*b* and a connection flange 244 substantially orthogonally connected to the first and second substantially F-shaped flanges 242*a*, 242*b* (collectively referred to as "F-shaped flanges 242"). The second substantially F-shaped flange 242*b* is optionally substantially similar to the first substantially F-shaped flange 242*a*, and as such can be described cumulatively with reference to the first substantially F-shaped flange 242*a*. Referring in particular to FIG. 7D, the first F-shaped flange 242*a* includes a substantially linear portion 246 having a first edge 248 and a second edge 250. The first edge 248 is connected to the connection flange 244. The second edge 250 includes a top tab 252 and a bottom tab 254. The top tab 252 includes a tip portion 256 and an angled toe portion 258 that gradually transitions into a step 260, forming a mouth 262. The bottom tab 254 also includes a toe portion 264 that gradually transitions into a step 266 to form a mouth 268.

Referring in particular to FIGS. 7E and 7F, the connection flange 244 has a first side 270 and a second side 272. The first side 270 faces away from the F-shaped flanges 242 and includes a plurality of dimples 274. As can be seen in FIG. 7F, the F-shaped flanges 242 and the connection flange 244 together form a U-shape. The F-shaped flanges 242 and the connection flange 244 may be connected by any means known in the art, including for example, welding. The cantilever signage system 200 is subsequently assembled in the same manner as the cantilever signage system 10 described above.

The bracket 222 is about 1.04 inches wide, about 2.44 inches high and about 0.376 inches thick. The F-shaped flanges 242 are about 0.98 inches wide (including the top tab 252 and the bottom tab 254), about 0.031 inches thick and about 2.44 inches high (including the tip portion 256), although other dimensions are contemplated. The connection flange 244 is about 0.313 inches wide, about 0.031 inches thick and about 2.25 inches high, although other dimensions are contemplated. The dimples 274 extend about 0.03 inches from the first side 270 of the connection flange 244, although other dimensions are contemplated.

Figure 8A:
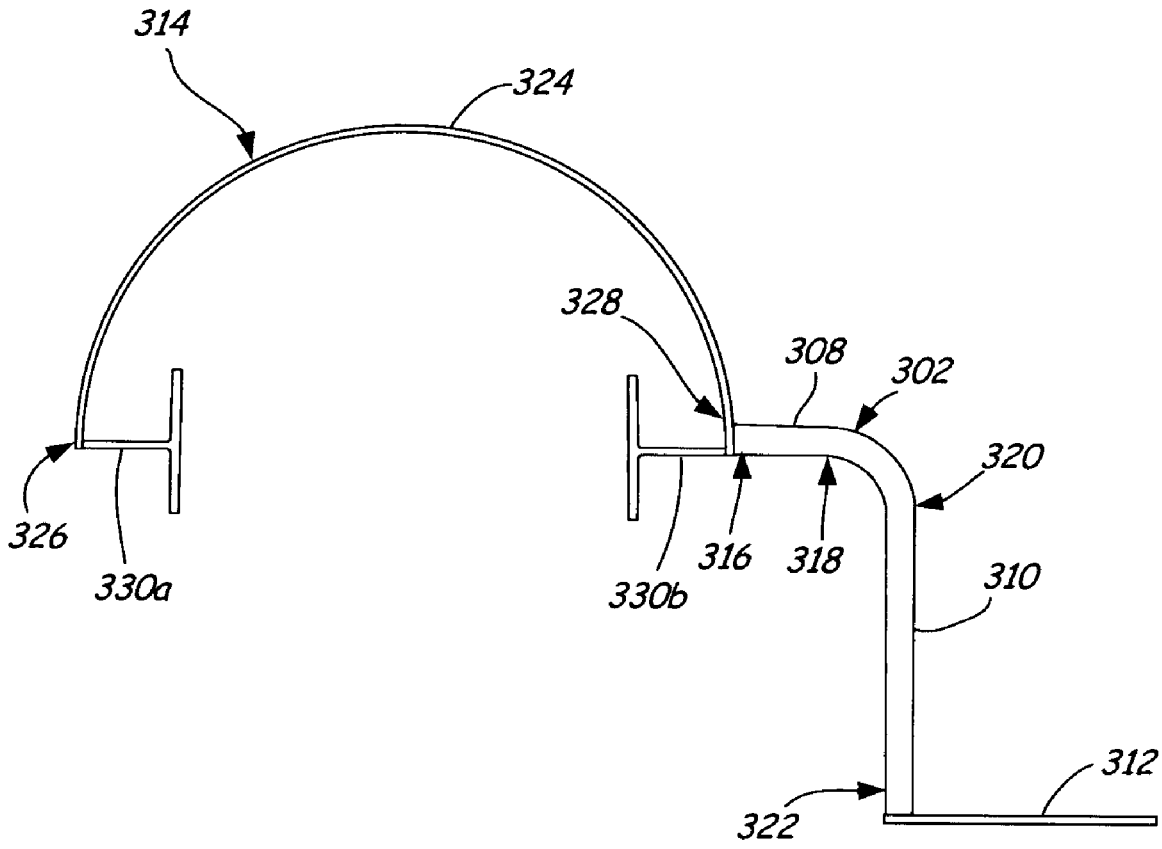
FIG. 8A is a side view of an embodiment of the support of FIG. 3, according to some embodiments.
Figure 8B:
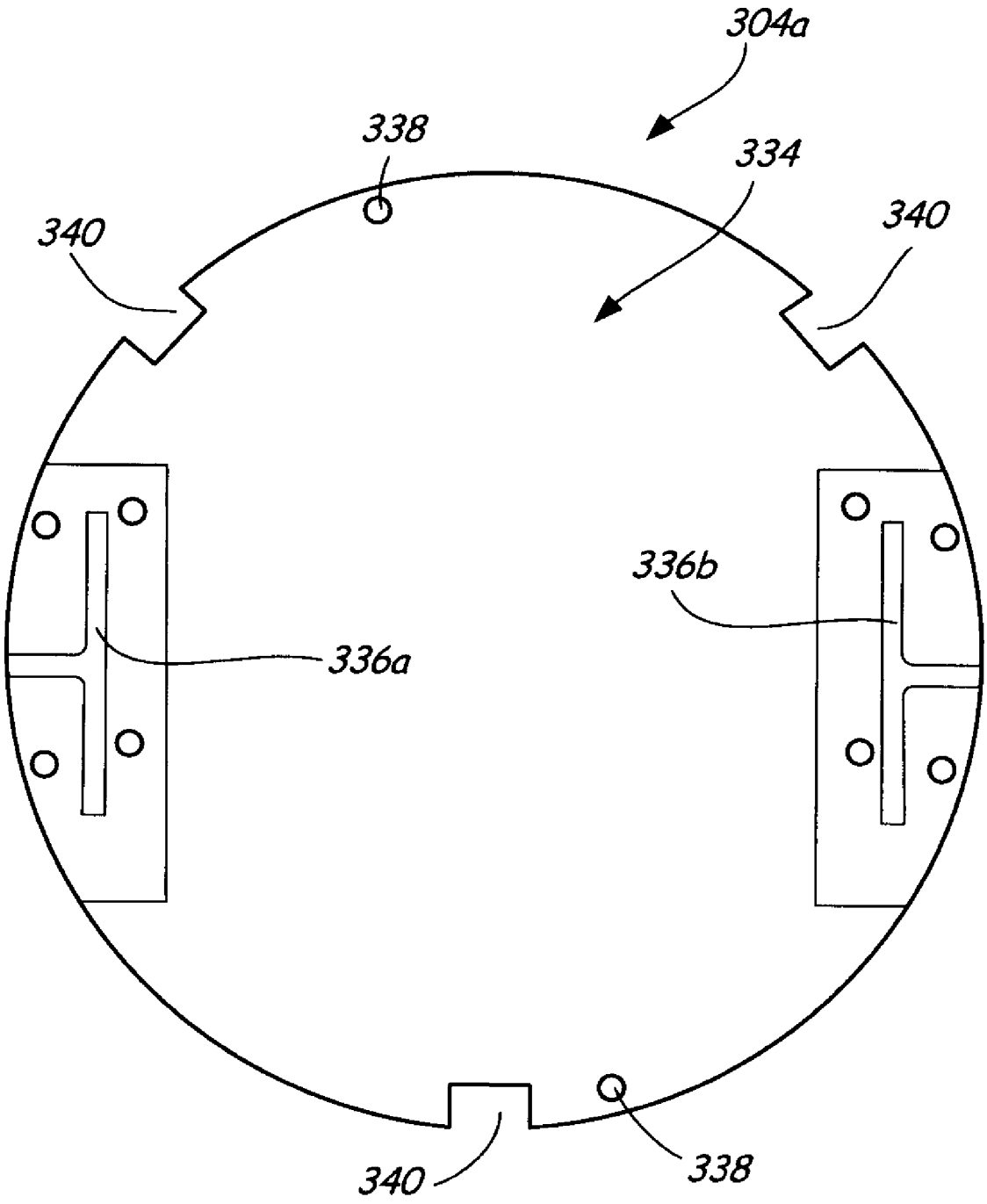
FIG. 8B is a front view of an embodiment of the plate of FIG. 4, according to some embodiments.
Figure 8C:
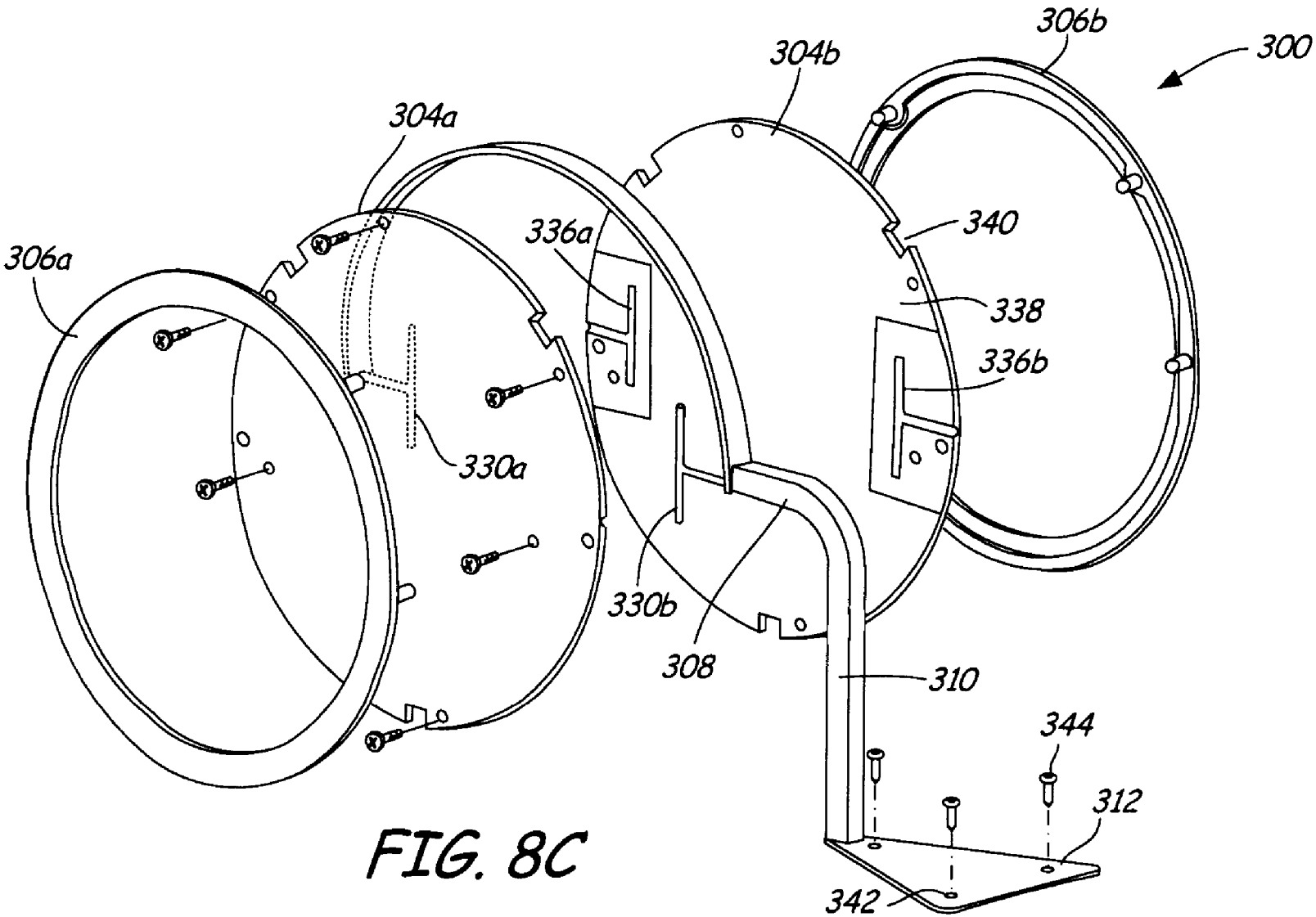
FIG. 8C is an exploded view of a cantilever signage system with the support of FIG. 8A and the plate of FIG. 8B, according to some embodiments.

FIGS. 8A-8C show an alternative cantilever signage system 300 and will be discussed in conjunction with one another. FIG. 8A shows a perspective view of an alternative support 302. FIG. 8B shows a front view of an alternative plate 304. FIG. 8C shows an exploded view of the cantilever signage system 300. The cantilever signage system 300 includes support 302, first plate 304*a* and second plate 304*b* (collectively referred to as "plates 304") and first ring 306*a* and second ring 306*b* (collectively referred to as "rings 306"). The support 302, plates 304 and rings 306 of the cantilever signage system 300 generally function and interact with each other in substantially the same manner as the support 12, plates 62 and rings 64 of the cantilever signage system 10 (shown in FIGS. 1-6) and the support 12, plates 404 and rings 406 of the cantilever signage system 400 (shown in FIGS. 7A-7C).

Referring to FIG. 8A, the support 302 includes a substantially horizontal arm 308, a substantially vertical arm 310, a mount 312 and a semi-circular shell 314. The substantially horizontal arm 308 has a first end 316 and a second end 318. The semi-circular shell 314 is attached to the first end 316 of the substantially horizontal arm 308 and the substantially vertical arm 310 is attached to the second end 318 of the substantially horizontal arm 308. The substantially vertical arm 310 has a first end 320 and a second end 322. The first end 320 of the substantially vertical arm 310 is attached to the second end 318 of the substantially horizontal arm 308 at a substantially 90 degree angle, for example. The mount 312 is attached at a substantially normal angle to the second end 322 of the substantially vertical arm 310 and functions to mount the cantilever signage system 300 to a substantially horizontal base.

The shell 314 includes a curved member 324 having a first end 326 and a second end 328, a first engagement member 330*a* and a second engagement member 330*b*. The first engagement member 330*a* is attached to the first end 326 of the curved member 324 and the second engagement member 330*b* is attached to the second end 328 of the curved member 324. The engagement members 330*a*, 330*b* (collectively referred to as "engagement members 330") resemble an inverted T-shape or a T-shape, respectively.

Referring now in particular to FIGS. 8B and 8C, each of the plates 304 includes a substantially smooth first surface 332 and a second surface 334. The second surfaces 334 of the plates 304 include a first recess 336*a*, a second recess 336*b*, a plurality of apertures 338 and a plurality of cut-outs 340 along the perimeter. The first and second recesses 336*a*, 336*b* (collectively referred to as "recesses 336") are designed to match the shape of the engagement members 330 of the shell 314. While the shapes of the engagement members 330 and the recesses 336 are substantially similar to one another, the shapes may vary from one another as long as at least a portion of the recesses 336 accept the engagement members 330. The cantilever signage system 300 is subsequently assembled in a substantially similar manner to the cantilever signage systems 10, 200 described above.

The mount 312 has a substantially triangular shape and includes a plurality of apertures 342 for connecting the cantilever signage system 300 to a substantially horizontal base by screws 344. The mount may be connected to the substantially vertical arm 310 by any of a variety of means, including for example, welding. Although FIG. 8C depicts the mount 312 as having a triangular shape, the mount 312 is optionally any of a variety of shapes, including, but not limited to: rectangular, square, oval, or circular. The substantially horizontal arm 308, substantially vertical arm 310, mount 312 and semi-circular shell 314 of the support 302 are secured together by welding, for example.

It should be noted that while the cantilever signage systems 10, 200, 300 are discussed separately, features of the supports 12, 202, 302, plates 62, 204, 304 and brackets/mount 16, 222, 312 are interchangeable among the cantilever signage systems 10, 200, 300.

Figure 9:
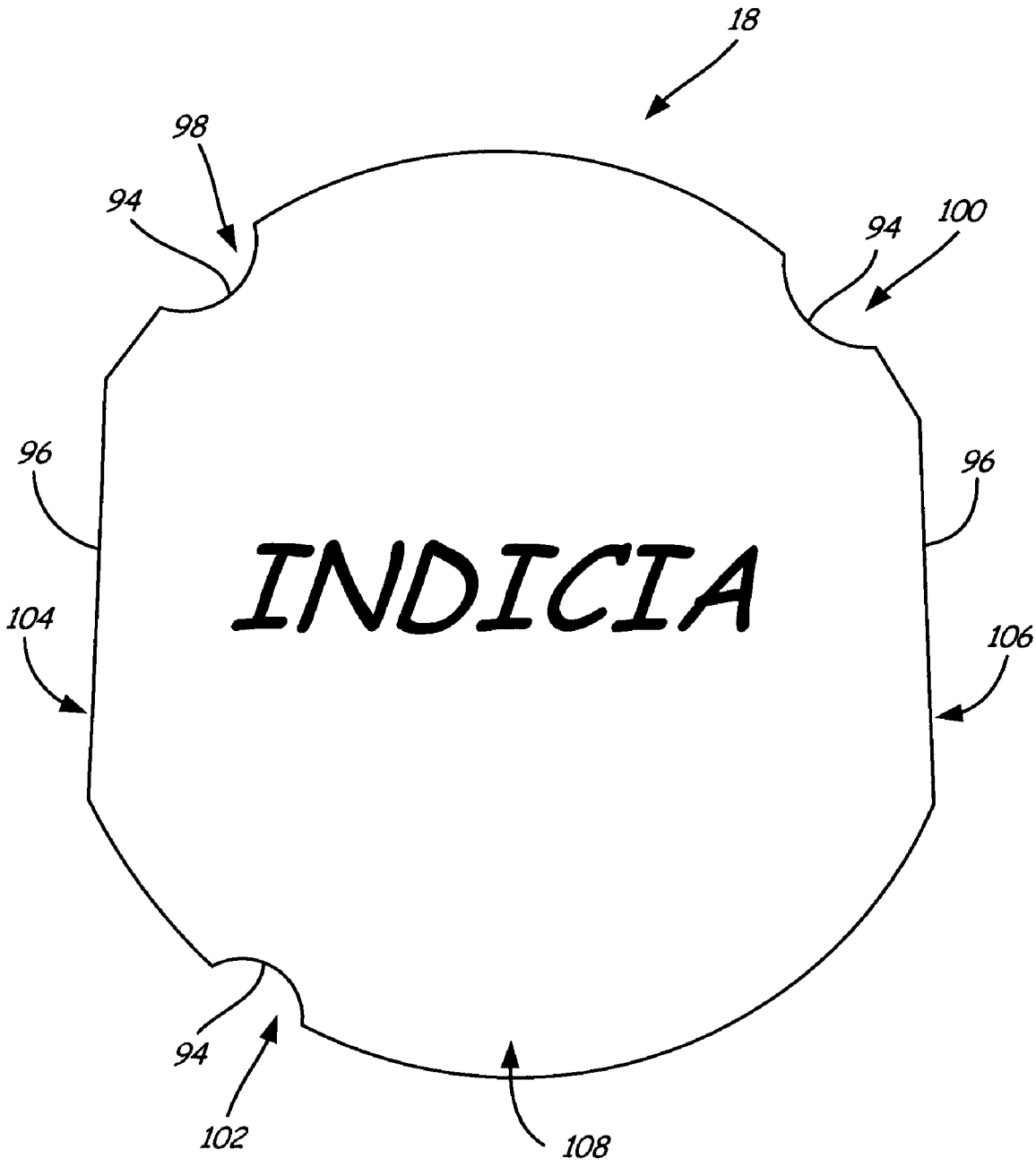
FIG. 9 is a front view of a sign of the cantilever signage system of FIG. 1, according to some embodiments.

FIG. 9 is a front view of the sign 18 of the cantilever signage system 10 of FIG. 1, according to some embodiments. Though described with reference to cantilever signage system 10, the sign 18 is also usable with the cantilever signage systems 200, 300. The sign 18 includes divots 94 at corners 98, 100, 102 and linear portions 96 along the perimeter at edges 104 and 106, respectively, shaped to fit within the outline created by the bumps 86 and the linear portions 88 of the step 82 of the rings 64 (shown in FIG. 5). The sign 18 optionally includes indicia on a first side 108 of the sign 18 to provide information to consumers in proximity to the cantilever signage system 10.

Figure 10:
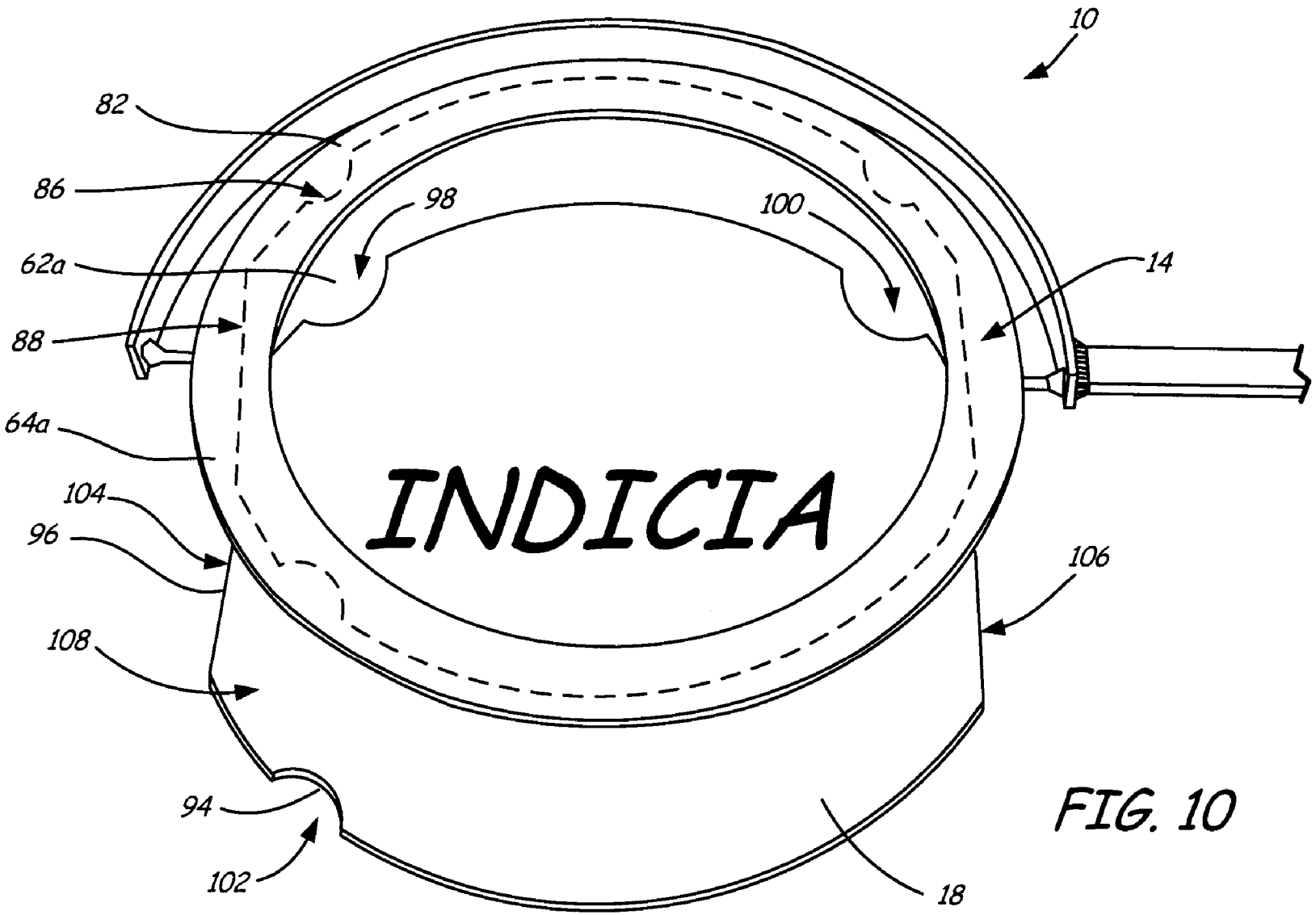
FIG. 10 is a perspective view of the sign of FIG. 9 being positioned within the cantilever signage system of FIG. 1, according to some embodiments.

FIG. 10 shows a perspective view of the sign 18 being positioned within the cantilever signage system 10. To position the sign 18 in the cantilever signage system 10, the bottom of the first ring 64*a* is first pulled away from the first plate 62*a*. The sign 18 is then inserted between the first ring 64*a* and the first plate 62*a* such that the first side 108 of the sign 18 is facing away from the first plate 62*a* and is viewable to a user through hole 80 of the first ring 64*a*. The sign 18 is inserted between the first ring 64*a* and the first plate 62*a* until the divots 94 of the sign 18 engage the bumps 86 of the step 82 of the first ring 64*a* (shown in dashed lines). When the sign 18 is properly positioned within the housing 14, the linear portions 96 of the sign 18 also line up with the linear portions 88 of the step 82 of the first ring 64*a*. The sign 18 is releasably retained within the housing 14 by frictional engagement of the corners 98, 100, 102 and edges 104, 106 of the sign 18 with the first ring 64*a* and the first plate 62*a* and the pressure of the first ring 64*a* against the first plate 62*a*. In some embodiments, the sign 18 is additionally maintained within the housing 14 by connection means at the bottom of the housing 14, such as clips 110 (shown in FIG. 1) that maintain the rings 64 to the plates 62. Although the sign 18 is discussed as being positioned between the first plate 62*a* and the first ring 64*a*, a second sign is also optionally positioned between the second plate 62*b* and the second ring 64*b* in a substantially similar manner. In addition, the sign 18 is assembled substantially similarly within the cantilever signage systems 200, 300.

Figure 11A:
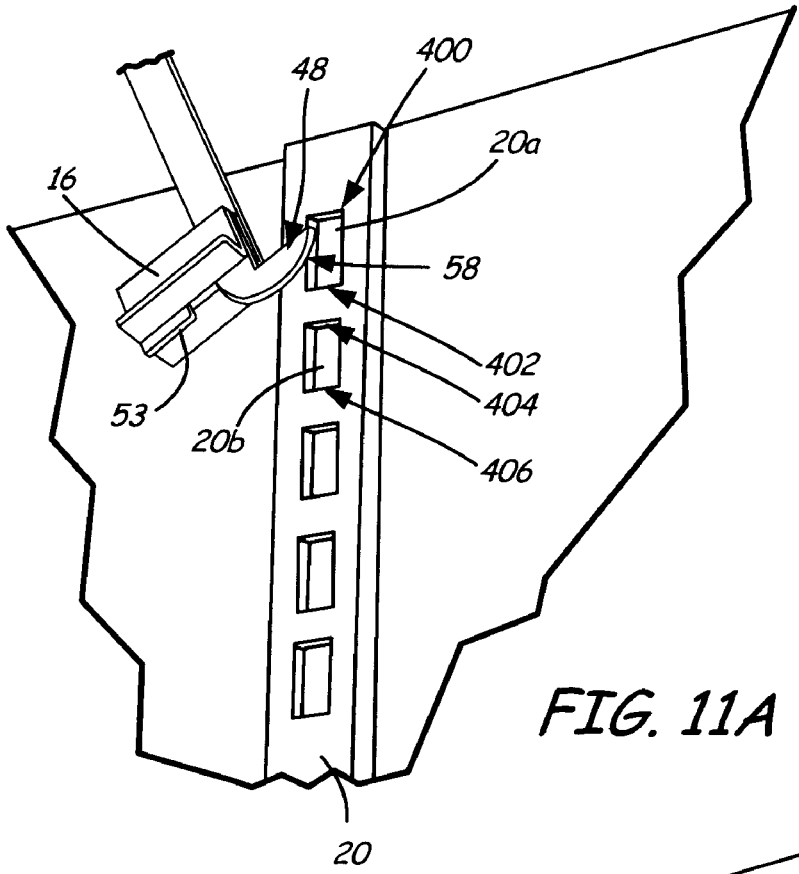
FIG. 11A is an enlarged partial perspective view of the bracket of FIGS. 3A-3C being assembled to an upright, according to some embodiments.
Figure 11B:
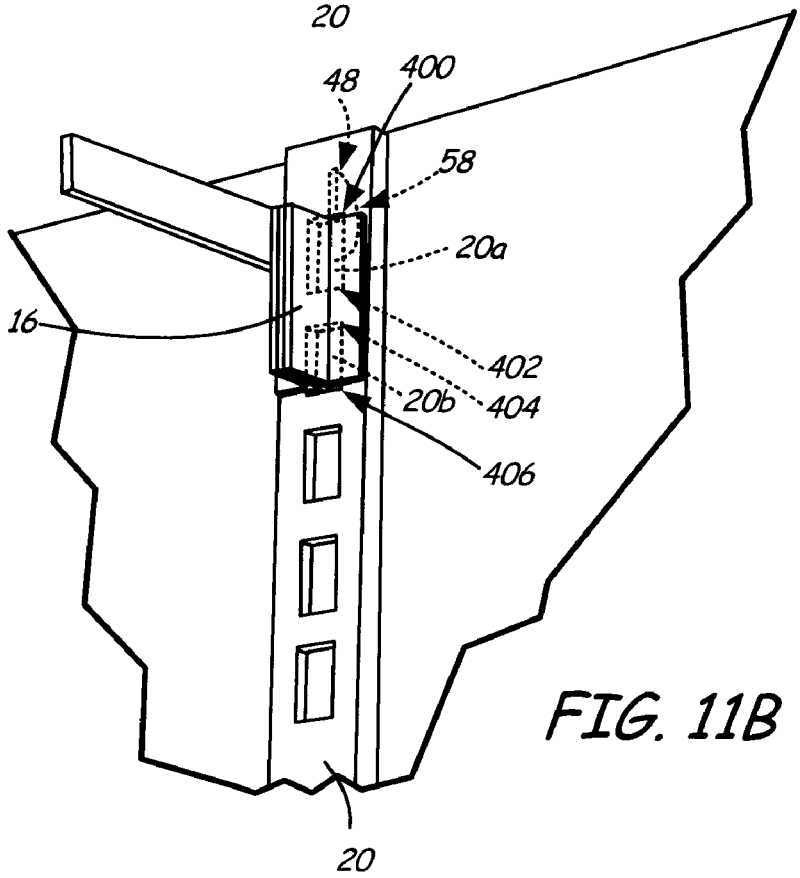
FIG. 11B is an enlarged partial perspective view of the bracket of FIGS. 3A-3C assembled to the upright, according to some embodiments.

FIG. 11A shows an enlarged partial perspective view of the bracket 16 of the cantilever signage system 10 depicted in FIGS. 3A-3C being assembled to the substantially vertical upright and FIG. 11B shows an enlarged partial perspective view of the bracket 16 assembled to the substantially vertical upright 20. As can be seen in FIGS. 11A and 11B, the first target hole 20*a* has a top edge of material 400 and a bottom edge of material 402 and the second target hole 20*b* has a top edge of material 404 and a bottom edge of material 406. Referring also to FIGS. 3A-3C, the method of assembling includes tipping the catch 48 of the bracket 16 up and inserting the tip portion 58 of the catch 48 of the bracket 16 into the first target hole 20*a* at an angle. The arched tip portion 58 of the catch 48 optionally facilitates smooth insertion of the tip portion 58 into the first target hole 20*a*.

Following insertion of the tip portion 58 into the first target hole 20*a*, the support 12, including the bracket 16, is pivoted downwardly toward the substantially vertical upright 20. Once the bracket 16 is pivoted downwardly, the tab 53 is inserted into the second target hole 20*b*. The bracket 16 is then moved downwardly so that the tip portion 58 rests on the bottom edge of material 402 of the first target hole 20*a* and the tab 53 rests on the bottom edge of material 406 of the second target hole 20*b*. The tip portion 58 the bracket 16 acts to releasably retain the bracket 16 in the target holes 20*a*, 20*b*. In addition, the tip portion 58 rests against the top edge of material 400 to help retain the bracket 16 to the substantially vertical upright 20. When the tip portion 58 catches the top edge of material 400, the cantilever signage system 10 is releasable from the substantially vertical upright 20 by pivoting and maneuvering the support 12 relative to the substantially vertical upright 20. It should be understood that the bracket 16 is optionally used with target holes of different sizes and/or that various brackets are optionally used, as desired.

With the assembly and arrangement described above, the bracket 16 provides means for releasably securing the support 12 to the base assembly 22 (shown in FIG. 1). From the preceding description, it should be understood that the weight of the housing 14 (shown in FIG. 1) optionally assists with retaining the bracket 16 in the downwardly, secure position. When release of the bracket 16 is desired, the support 12 is slid upwardly with the housing 14 moving outwardly and away from the substantially vertical upright 20. The tip portion 58 and the tab 53 are removed from the bottom edges of material 402, 406 such that the bracket 16 is removed from within the target holes 20*a*, 20*b* respectively.

The bracket 222 of the cantilever signage system 200 is assembled to the substantially vertical upright 20 in a substantially similar manner.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A signage system comprising:

a support including:

a substantially horizontal member having a first end and a second end;

a bracket for mounting the support to an upright, wherein the bracket is attached to the first end of the substantially horizontal member; and a shell extending from the second end of the substantially horizontal member;

a housing attached within the shell of the support, the housing including:

a first ring;

a second ring connected to the first ring;

a first plate positioned between the first ring and the second ring; and a second plate positioned adjacent to the first plate and between the first ring and the second ring; and a first sign releasably retained between the first ring and the first plate by frictional engagement of edges of the first sign with the first ring and the first plate.

2. The signage system of claim 1, wherein the support and the housing function as a cantilever.

3. The signage system of claim 1, wherein the shell is semi-circular and the housing is substantially concentric with the semi-circular shell of the support.

4. The signage system of claim 1, wherein the support further comprises a substantially vertical member positioned between the substantially horizontal member and the means for mounting.

5. The signage system of claim 1, further comprising a second sign positioned between the second plate and the second ring.

6. The signage system of claim 5, wherein the second sign is frictionally and releasably retained between the second plate and the second ring.

7. The signage system of claim 1, wherein the first sign is shaped to engage a shape outlined between an inner perimeter and an outer perimeter of the first ring.

8. The signage system of claim 1, wherein the shell includes an engagement member and wherein the first plate includes a recess for engaging the engagement member.

9. An informational system comprising:

an elongate body having a first end and a second end;

an extension attached to the second end of the elongate body, wherein the extension is releasably securable to a standard;

a casing for releasably holding a sign, the casing including:

a hoop;

a disc having an imprint; and means for maintaining the disc against the hoop; and a member having an engagement portion, wherein the member is attached to the first end of the elongate body and releasably attached to the casing;

wherein:

the engagement portion of the member is positionable within the imprint;

the elongate body, the member, the extension and the casing are adapted to be cantilevered from a substantially vertical standard, the casing includes at least two hoops and at least two discs, and the at least two discs are positioned between the hoops.

10. The informational system of claim 9, further comprising means for maintaining the discs between the hoops.

11. The informational system of claim 9, wherein the extension comprises at least one of a bracket and a mount.

12. The informational system of claim 9, wherein the member includes a curved member defining an arc, wherein the engagement member is positioned within the arc of the curved member.

13. An informational system comprising:

an elongate body having a first end and a second end;

an extension attached to the second end of the elongate body, wherein the extension is releasably securable to a standard;

a casing for releasably holding a sign, the casing including;

a hoop;

a disc having an imprint; and means for maintaining the disc against the hoop; and a member having an engagement portion;

wherein:

the member is attached to the first end of the elongate body and releasably attached to the casing;

the engagement portion of the member is positionable within the imprint, the elongate body, the member, the extension and the casing are adapted to be cantilevered from a substantially vertical standard, the member includes a curved member defining an arc, the engagement member is positioned within the arc of the curved member, and the hoop and the disc are positionable within the arc of the curved member.

14. An informational system comprising:

an elongate body having a first end and a second end;

an extension attached to the second end of the elongate body, wherein the extension is releasably securable to a standard;

a casing for releasably holding a sign, the casing including;

a hoop;

a disc having an imprint; and means for maintaining the disc against the hoop; and a member having an engagement portion;

wherein:

the member is attached to the first end of the elongate body and releasably attached to the casing, the engagement portion of the member is positionable within the imprint, the elongate body, the member, the extension and the casing are adapted to be cantilevered from a substantially vertical standard, and the hoop includes a step between an inner perimeter and an outer perimeter of the hoop.

15. A method of displaying a sign comprising:

releasably attaching a signholder to a mount, wherein the signholder includes a first frame, a first panel positioned adjacent the first frame, a second frame, and a second panel, wherein the second panel is positioned between the first panel and the second frame;

releasably connecting an arm of the mount to a base assembly, wherein the signholder and the mount are cantilevered to the base assembly such that the signholder extends substantially horizontally outward from the base assembly and is suspended above a retail floor;

sliding the sign upwardly between the first frame and the first panel; and maintaining the sign between the first frame and the first panel for display by frictionally engaging an edge of the sign.

16. The method of claim 15, performed in a retail environment.

17. The method of claim 15, wherein releasably connecting the mount to the base assembly comprises engaging an engagement member of the mount with a recess of the base assembly.

* * * * *